US009831056B2

(12) United States Patent
Mochizuki et al.

(10) Patent No.: US 9,831,056 B2
(45) Date of Patent: Nov. 28, 2017

(54) PROTECTION DEVICE

(71) Applicant: LITTELFUSE JAPAN G.K., Kawasaki-shi (JP)

(72) Inventors: Hirofumi Mochizuki, Ryugasaki (JP); Katsuaki Suzuki, Ryugasaki (JP); Arata Tanaka, Ryugasaki (JP)

(73) Assignee: Littelfuse Japan G.K., Motasaka, Minato-ku (JP)

( * ) Notice: Subject to any disclaimer, the term of this patent is extended or adjusted under 35 U.S.C. 154(b) by 236 days.

(21) Appl. No.: 14/353,263

(22) PCT Filed: Oct. 19, 2012

(86) PCT No.: PCT/JP2012/077107
§ 371 (c)(1),
(2) Date: Oct. 14, 2014

(87) PCT Pub. No.: WO2013/058362
PCT Pub. Date: Apr. 25, 2013

(65) Prior Publication Data

US 2015/0035641 A1 Feb. 5, 2015

(30) Foreign Application Priority Data

Oct. 20, 2011 (JP) ..... 2011-230849
Jul. 26, 2012 (JP) ..... 2012-165983

(51) Int. Cl.
*H01H 83/20* (2006.01)
*H01H 37/54* (2006.01)
(Continued)

(52) U.S. Cl.
CPC ..... *H01H 83/20* (2013.01); *H01C 7/02* (2013.01); *H01C 7/027* (2013.01);
(Continued)

(58) Field of Classification Search
CPC ..... H01H 37/5427; H01H 37/5436; H01H 71/025; H01H 71/164; H01H 83/20;
(Continued)

(56) References Cited

U.S. PATENT DOCUMENTS 5,497,286 A * 3/1996 Shimada ..... H01H 81/02 337/102
5,607,610 A * 3/1997 Furukawa ..... H01H 1/504 219/488

(Continued)

FOREIGN PATENT DOCUMENTS

JP 2005-129471 A 5/2005
JP 2005-174816 A 6/2005

(Continued)

OTHER PUBLICATIONS

Shibuya, Translation of JP 2005203277 A.*
International Search Report for International Application No. PCT/JP2012/077107, dated Nov. 20, 2012.

*Primary Examiner* — Anatoly Vortman
*Assistant Examiner* — Jacob Crum

(57) ABSTRACT

A protection device comprises a resin base, PTC component, bimetal component, arm and upper plate which are housed in a resin housing wherein the base includes a terminal integrated with the base by insert molding. A resin cover is formed by insert molding to cover the PTC component, bimetal component, arm and upper plate which are superposed in this order over the terminal within a space in the base. The space in the resin base is substantially closed by the upper plate, the base and the cover are integrally bonded to define the resin housing, the terminal and the arm are electrically connected in series in a normal state, and in an abnormal state where the bimetal component is activated, the terminal and the arm are electrically cut off, while the terminal, PTC component, bimetal component, and arm are electrically connected in series in this order.

9 Claims, 3 Drawing Sheets

(51) Int. Cl.

| | |
|---|---|
| ***H01H 37/04*** | (2006.01) |
| ***H01H 69/02*** | (2006.01) |
| ***H01C 7/02*** | (2006.01) |
| *H01H 71/02* | (2006.01) |
| *H01H 1/26* | (2006.01) |

(52) U.S. Cl.
CPC ..... *H01H 37/043* (2013.01); *H01H 37/54* (2013.01); *H01H 69/02* (2013.01); *H01H 71/025* (2013.01); *H01H 1/26* (2013.01); *H01H 37/5436* (2013.01); *H01H 2071/0242* (2013.01); *Y10T 29/49105* (2015.01)

(58) Field of Classification Search
CPC ..... H01H 2071/165; H01H 71/0221; H01H 2071/0242; H01H 1/26; H01H 37/043; H01H 37/54; H01H 69/02; H01C 7/02; H01C 7/027
USPC ..... 337/77, 102, 350, 377, 380–381, 390
See application file for complete search history.

(56) References Cited

U.S. PATENT DOCUMENTS

| | | | | | |
|---|---|---|---|---|---|
| 5,847,637 | A * | 12/1998 | Takeda | H01H 37/5427 | 337/3 |
| 5,867,084 | A * | 2/1999 | Hofsass | H01H 37/5427 | 337/327 |
| 5,867,085 | A * | 2/1999 | Kruck | H01H 11/0056 | 337/333 |
| 6,396,381 | B1 * | 5/2002 | Takeda | H01H 1/504 | 337/342 |
| 6,448,884 | B1 * | 9/2002 | Yamaguchi | H01H 39/00 | 180/279 |
| 6,503,647 | B1 * | 1/2003 | Sugiyama | H01M 2/202 | 429/61 |
| 6,559,752 | B1 * | 5/2003 | Sienkiewicz | H01H 37/5418 | 337/343 |
| 6,633,222 | B2 * | 10/2003 | Nagai | H01H 37/54 | 337/333 |
| 2003/0122650 | A1 * | 7/2003 | Yamamoto | H01H 37/5427 | 337/333 |
| 2008/0124970 | A1 * | 5/2008 | Yasuda | H01R 13/405 | 439/527 |
| 2010/0081015 | A1 * | 4/2010 | Kim | H01M 2/0404 | 429/7 |
| 2010/0308954 | A1 * | 12/2010 | Takeda | H01H 37/32 | 337/398 |

FOREIGN PATENT DOCUMENTS

| | | | |
|---|---|---|---|
| JP | 2005-203277 | A | 7/2005 |
| JP | 2005-285604 | A | 10/2005 |
| JP | 2011-134624 | A | 7/2011 |

* cited by examiner

PROTECTION DEVICE

FIELD OF THE INVENTION

The present invention relates to a protection device which comprises a bimetal component and a PTC component and substantially interrupts a current through an electrical or an electronic apparatus when an excessive current flows through such apparatus or when a temperature of the electrical or electronic apparatus or an ambient temperature thereof rises excessively.

BACKGROUND OF THE INVENTION

When an abnormality occurs, for example, when a current excessively flows through an electrical apparatus (for example, a motor) thereby causing the electrical apparatus to reach an abnormally high temperature or when the electrical apparatus reaches an abnormally high temperature due to some reason other than the excessive current, it is needed to secure a safety of the electrical apparatus by interrupting the current flowing through the electrical apparatus and eliminating the abnormality as necessary. A bimetal component is used as a means to interrupt such current.

A bimetal component comprises a sheet member of bimetal metal. The bimetal component is configured to activate (i.e. deform) and interrupt a current flowing through the bimetal component when the bimetal itself reaches a high temperature in excess of a particular temperature, or when the bimetal reaches a high temperature in excess of a particular temperature due to a rise in the temperature of an ambient atmosphere.

When such bimetal component is incorporated in an electrical apparatus, the bimetal component activates when the electrical apparatus reaches an abnormal temperature due to an excessive current or some other reason and interrupts the current. The temperature of the electrical apparatus decreases by an interruption of the current, and the temperature of the bimetal component also decreases so that the bimetal component returns to its original shape (i.e. resets), and as a result, the current may be allowed to flow again before the safety of the electrical apparatus is secured.

In order to prevent the current from flowing again in this manner, it is necessary to ensure and maintain the state when the bimetal are activated. For this purpose, the bimetal component is disposed in series in the circuit of the electrical apparatus to interrupt the circuit current, while at the same time a PTC component is disposed in parallel to the bimetal component. By such arrangement, when the bimetal component is activated, the current flowing through it is diverted to the PTC component; the PTC component generates a Joule heat by the current and this heat is transmitted to the bimetal component so that the activated state of the bimetal component may be ensured.

A protection device which is configured so that the bimetal component is disposed in series in the electrical circuit and the PTC component is disposed in parallel to the bimetal component is known. Such protection device is disclosed, for example, in the Patent Reference 1 shown below. In such protection device, a resin base having terminals comprises a PTC component, a bimetal component and an arm within a space provided in the resin base; a cover which is previously provided with an upper plate is placed on the resin base, and the resin base and the resin cover in this state are bonded with an adhesive or by ultrasound fusion.

Japanese Publication No. JP 2005-203277 is a prior patent reference.

SUMMARY OF THE INVENTION

As a result of variously studying the function performance of a protection device as described above, the inventors found that, while combining the property of the bimetal component and the property of the PTC component is superior in terms of solving the problems caused by the bimetal component resetting, the maintenance of good electrical connections in the contact portions between various elements disposed inside the device is not necessarily adequate, as a result of which the protection device may not adequately achieve its function.

After further studying, it was concluded that, although a resin housing is formed from the resin base and the resin cover, it was undesirable that oxygen around the protection device penetrates into the resin housing to oxidize the metal parts of the elements such as the bimetal component and the PTC component.

The problem to be solved by the present invention is to provide, a novel protection device which comprises the bimetal component and the PTC component wherein the penetration of oxygen thereinto is further suppressed, and a process for producing the protection device.

As a result of intensively studying the above problem, it was concluded to be able to resolve the problem by configuring the protection device so that the space in the resin base is substantially closed with an upper plate. Furthermore, it was found that such protection device could be produced by placing a PTC component, a bimetal component and an arm within the space in the resin base, and then insert-molding them with closing the space in the resin base with the upper plate.

Therefore, in the first aspect, the present invention provides a protection device which comprises a resin base, a PTC component, a bimetal component, an arm and an upper plate which are housed in a resin housing wherein

- the resin base comprises a terminal which are integrated with the resin base by insert molding,
- the protection device further comprises a resin cover which is formed by insert molding so as to cover the PTC component, the bimetal component, the arm and the upper plate which are superposed in this order over the terminal within a space in the resin base,
- the space in the resin base is substantially closed by the upper plate,
- the resin base and the resin cover are integrally bonded to define the resin housing,
- the terminal and the arm is electrically connected in series in a normal state, and
- in an abnormal state where the bimetal component is activated, the terminal and the arm are electrically cut off, while the terminal, the PTC component, the bimetal component, and the arm are electrically connected in series in this order.

In the protection device of the present invention, since the resin base and the resin cover are integrally bonded in a state that the upper plate which is placed disposed on the arm closes the space in the resin base, it becomes more difficult for oxygen to penetrate into the space in the resin base.

In one preferred embodiment of the present invention, an outer surface of the wall defining the space in the resin base and an inner surface of the wall defining the resin cover are integrally bonded with being adjacent. In this case, the bonding of the resin base and the resin cover is surface-bonded (i.e. bonding between the surface of the resin base and the surface of the resin cover). Therefore, since the oxygen penetration path from the outside of the protection device to within the space in the resin base becomes longer, it becomes more difficult for oxygen to penetrate into the space since. In such surface contact, it is preferred that the space in the resin base is defined by a wall surface present around its entire perimeter and that the resin cover has a wall surface adjacent to the outer surface of the wall defining the space around its entire perimeter. In this case, a longer penetration path is secured around the entire perimeter of the resin housing.

In a more preferred embodiment, the PTC component, the bimetal component, and the arm are disposed within the space in the resin base over a terminal exposed at the bottom of the space in the resin base, and in this state, an assembly of these elements is formed so that the upper plate which is disposed on the arm substantially closes the space, and then the resin cover is formed around the assembly by injection-molding in a state of putting the assembly in a prescribed metal mold, i.e. insert-molding. As a result, the resin cover and the resin base are integrally bonded so as to form a resin cover which covers so that there is substantially no exposed portion other than the lower surface of the resin base.

By such insert-molding, the surface defining the resin base and the surface defining the resin cover are integrally bonded in parts where they are adjacent to each other, and preferably a resin housing is formed wherein the outer surface of the wall defining the space in the resin base and the inner surface of the wall defining the resin cover are integrally bonded with being adjacent. However, though the end section of the terminal extends outward through one of the side walls of the resin housing, and the end section of the arm extends outward through the other side wall of the resin housing in order to connect the protection device to a prescribed circuit or to an electrical element which is connected the circuit (for example, a lead, a pad, a land, a wiring, and the like), it is preferable that the various elements which are disposed within the resin housing, for example, the section other than the end section of the terminal, the PTC component, the bimetal component, the section other than the end section of the arm (the substantially movable section) and the upper plate are not exposed on the outside of the resin housing. In particular, it is preferred that the section other than the end section of the terminal is not exposed on the lower surface of the resin base.

In one preferred embodiment of the protection device of the present invention, the resin base and the resin cover are made of the same plastic material. The plastic material which can be used may be any appropriate material, and a liquid crystal polymer called an LCP, in particular a thermotropic type, may be used. As the liquid crystal polymer, an aromatic polyester-based resin can be exemplified. In an other embodiment, the resin base and the resin cover may be made of different plastic materials. In this case, it is preferred that the polymer materials are mutually compatible. When the same plastic material or the mutually compatible plastic materials are used, the integrity of the resin base and the resin cover by bonding is more fully ensured.

In the second aspect, the present invention provides a process for producing a protection device which comprises a resin base, a PTC component, a bimetal component, an arm and an upper plate which are housed in a resin housing wherein the process comprises the steps of:

(1) forming a resin base which is integrated with a terminal and has a space over the terminal by insert molding using the terminal as an insert, (2) superposing the PTC component, the bimetal component, the arm and the upper plate over the terminal in this order to form an assembly thereof, and (3) placing the assembly as an insert into a metal mold, and insert molding a resin cover in a state where the upper plate closes the space in the resin base.

In the process for producing the protection device of the present invention, the PTC component, the bimetal component and the arm are placed within the space in the resin base, and then, the insert-molding may be performed in a state where the upper plate closes the space in the resin base to integrally bond the resin cover with the resin based. By such insert-molding, the bond between the resin base and the resin cover may be surface-bonded, and it becomes more difficult for oxygen to access to the space in the resin base In the protection device of the present invention, internal penetration of oxygen from the outside is more difficult, and as a result, the protection device can perform its function stably for a long time. In addition, in the process for preparing the protection device of the present invention, a protection device that can perform its function stably for a long time can easily be produced.

DETAILED DESCRIPTION OF THE INVENTION

Figure 1:
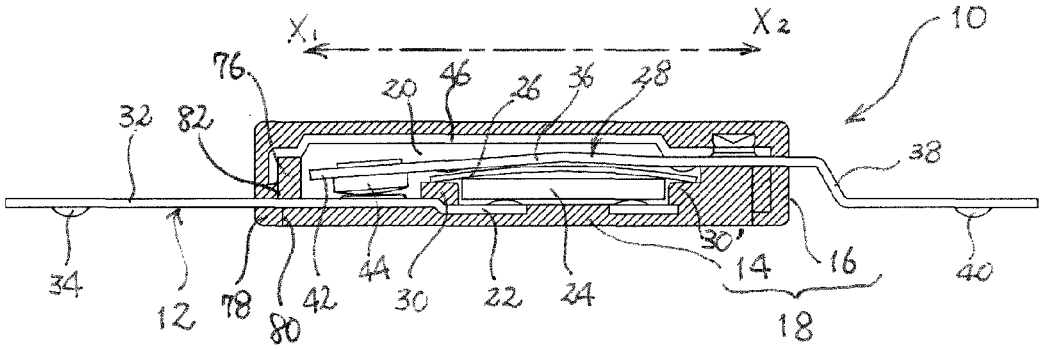
FIG. 1 schematically shows a protection device of the present invention in its cross-sectional view.

Next, the present invention will be further described in detail with reference to the accompanied drawings. The present invention is basically characterized in that the protection device is configured such that the upper plate substantially closes the space in the resin base; and such the protection device has the PTC component, the bimetal component and arm which are disposed within the space in the resin base, and then insert-molding in a state where the space in the resin base is closed with an upper plate; as well as technical particulars related thereto. Since known particulars such as are disclosed in the above patent reference can be applied to other parts of the protection device and the process for producing the protection device according to the present invention, a detailed description will be omitted. Therefore, unless otherwise specified, a known shape and a material can be used for the various elements constituting the protection device of the present invention. It is noted that for the PTC component, the use of a so-called polymer PTC component is particularly preferred.

The polymer PTC component comprises a laminate PTC element which is formed by the extruding of a conductive composition containing a polymer (for example, polyethylene, polyvinylidene fluoride, and the like) in which are dispersed a conductive filler (for example, carbon black, nickel alloy, and the like), and electrodes (for example, metal foil) which are disposed on both sides thereof. In an other embodiment, the PTC component may be a so-called ceramic PTC component in which the PTC element is made of ceramic.

When the polymer PTC component is used as the PTC component in the protection device of the present invention, its resistance value is preferably 0.5Ω or more, more preferably 0.60Ω or more, for example, 0.65Ω or more. In this case, when the bimetal component activates, the PTC component can supply heat generally required to maintain the state of the activating. When the resistance value is lower than the above value, there is a possibility that the protection device raises chattering and a malfunction. In addition, the resistance value of the polymer PTC component is preferably 10Ω or less. For a PTC component having the higher resistance than the above value, it is not sometimes easy to reduce the variation in the resistance value when producing it.

It is noted that, in the applicant's examination, when 1 V (direct current)/23 A was applied, a protection device using a ceramic PTC component (the resistance value: 10Ω) raised chattering, while when a polymer PTC component having the resistance value of 0.65Ω was used, there was no chattering. According to various studies of the inventor, it is presumed that chattering can be substantially avoided when the resistance value of the polymer PTC component is 0.5Ω or more, in particular 0.60Ω or more.

It is noted that the resistance value of the polymer PTC component means a resistance value which is calculated from a current value and a applied voltage (measure by a four-terminal method, an applied current in a measuring range of a resistance measurement equipment: 100 mA) which are measured when a voltage of 6.5 mV (direct current) is applied at 25° C. between both electrodes of a PTC component which is produced by the pressure-bonding of electrodes (preferably, nickel foils) on both sides of a PTC element which is obtained by the extrusion of an electrically conductive composition comprising a polymer. It is noted that since a resistance value of the electrodes is negligibly small in comparison with the resistance value of the PTC element, the resistance value of the PTC component is substantially equal to the resistance value of the PTC element.

Furthermore, in the protection device of the present invention, when the polymer PTC component is used as the PTC component, the resistance value is preferably 1.2Ω or more, more preferably 3.5Ω or more, particular preferably 4Ω or more, for example, 4.5Ω or more. In use of the protection device of the present invention, a small amount of current (a leak current) can be flowed through a circuit even when the bimetal component activates and divert the current flowing through the circuit, and the polymer PTC component trips. It is sometimes preferable that this leak current is smaller. For example, when the protection device is used in an electrical equipment such as a secondary battery pack, there is demand to decrease the leak current to 200 mA or less at 25° C. under an applied voltage of 3 V. The demand is satisfied by the increase of the resistance value to some degree as described above, for example, by 4Ω or more of the resistance value of the polymer PTC component.

It is noted that in the protection device of the present invention, when the polymer PTC component is used as the PTC component, it was experimentally confirmed that under a condition that a measuring temperature was 25° C. and an applied voltage was 3 V (direct current), the leak current was 175 mA when the resistance value of the polymer PTC component was 4.5Ω, the leak current was 220 mA when the resistance value of the polymer PTC component was 1.7Ω, and the leak current was 225 mA when the resistance value of the polymer PTC component was 0.8Ω. The resistance value of the polymer PTC component was changed by the adjustment of an amount of carbon black as an electrically conductive filler.

Figure 2:
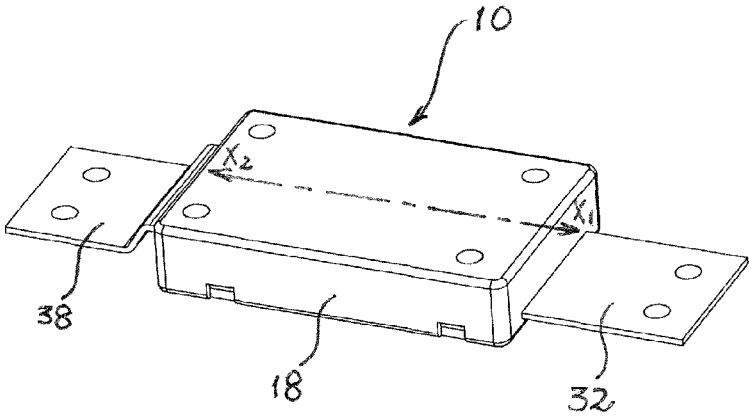
FIG. 2 schematically shows the protection device of the present invention in its perspective view.

The protection device of the present invention is schematically shown in FIG. 1 in its cross-section view and in FIG. 1 in its perspective view. It is noted that the cross-section view of FIG. 1 shows a state inside the protection device when the protection device is cut vertically along the plane containing the line $X_1$-$X_2$ which is shown as a single-dot chain line in FIG. 2. However, as is shown by the single-dot chain line $X_1$-$X_2$ in FIG. 1, the directions of left and right are reversed in FIG. 1 and FIG. 2.

The protection device 10 of the present invention comprises a resin housing 18 which is formed by integrally bonding a resin base 14 comprising a terminal 12 and a resin cover 16. The resin base 14 has a space 20; a part 22 of the terminal 12 is exposed at the bottom thereof, a PTC component 24 is disposed over the part, a bimetal component 26 (a bimetal plate) is disposed over it, and an arm 28 is disposed over it. The bimetal component 26 is supported on a protrusion 30 and a step section 30' which are provided in the space 20 of the resin base and is separated from the PTC component 24 (this separated state is not necessarily clear in FIG. 1, but is actually separated with ample space in-between). It is noted that in a normal state, the bimetal component is in a curved state such that it is an upward convex, and when a prescribed temperature is exceeded, it activates and deforms into a downward convex, as a result of which, it comes in contact with the PTC component 24, more particularly its metal electrode, so that it is electrically connected to the PTC component 24. In one preferred embodiment, the bimetal component 26 may have a protrusion, which is separated from the PTC component in a normal state, for example, a dome-shaped convex part of which the tip part is separated from the PTC component, on near the center of the lower surface. This protrusion is structured such that, when the bimetal component activates and becomes the downwardly convex state from the upwardly convex state shown in FIG. 1 or FIG. 3, it comes in contact with the PTC component. In this case, since the arm 28 is pushed upward an extra amount corresponding to the height of the protrusion, the arm is sufficiently pushed up even when the degree of curvature of the bimetal component itself is smaller, therefore, it is advantageous to provide such protrusion.

The remaining portion 32 from said part 22 of the terminal 22 extends outward through the side of the resin housing 18. This portion 32 is for electrically connecting to a prescribed electrical element and performs a primary function of the terminal. As is illustrated, a contact 34 may be provided on the portion 32.

A portion 36 of the arm 28 is positioned within the space 20 of the resin base, and the remaining portion 38 extends outward through the side of the resin housing as is the terminal 12. This portion 38 is for electrically connecting to a prescribed electrical element and performs a function similar to the terminal 12. As is illustrated, a contact 40 may be provided on the portion 38.

As is illustrated, it is preferable that the portion 36 of the arm is formed into a bent shape such that its tip part 42 is positioned somewhat lower, and a contact 44 is provided on the tip part 42. In the illustrated embodiment, the protection device is shown in a normal state, and the contact 44 is in contact with the exposed part 22 of the terminal. When the bimetal component 26 is activated and becomes upwardly convex as described above, the bimetal component 36 comes in contact with the PTC component 24 and pushes the portion 36 of the arm upwards, as a result of which, the tip part 42 moves upwards and the contact between the contact 44 and the terminal 22 is released.

As a result, in a normal state, the current flows in the order of the terminal 12→the contact 44→the tip part 42→the portion 36 of arm→the portion 38 of arm or the reverse order, and when the bimetal is activated, the current flows in the order of the terminal 12→P the TC component 24→the bimetal component 26→the portion 36 of arm→the portion 38 of arm or the reverse order. When current flows through the PTC component 24, the PTC element generates heat, and the deformed state of the bimetal component 26 can be maintained by this heat.

In the protection device of the present invention, an upper plate 46 is disposed over the portion 36 of the arm. The upper plate 46 has a function that, when the portion 36 of the arm moves upwards by the activation of the bimetal component 26, the upper plate comes in contact with the tip part 42 or the contact 44 (strictly, on the opposite side of the illustrated contact) which may be in a heated state caused by the heat from the bimetal component 26 which is in a prescribed high temperature and dissipates the heat. Therefore, the upper plate 46 preferably has a superior thermal conductivity. The heat is dissipated from the end section of the upper plate 46 through the arm which is in contact thereto via the portion 38. Therefore, the upper plate 46 is formed, for example, from a metal sheet. As a result, the quantity of heat transmitted from the bimetal component 26 to the resin cover 16 may be decreased as much as possibly to minimize the effect on the resin cover caused by heat.

As is illustrated, the upper plate 46 substantially closes the space 20 which is defined by the resin base 16. It is noted that the term "substantially close" means that, when insert-molding is performed to form the resin cover 16 in the process for producing the protection device of the present invention, the melted resin used in molding cannot penetrate into the space 20. In other words, it means that, the resin used to form the resin cover does not penetrate into the space 20 in the protection device of the present invention.

Figure 3:
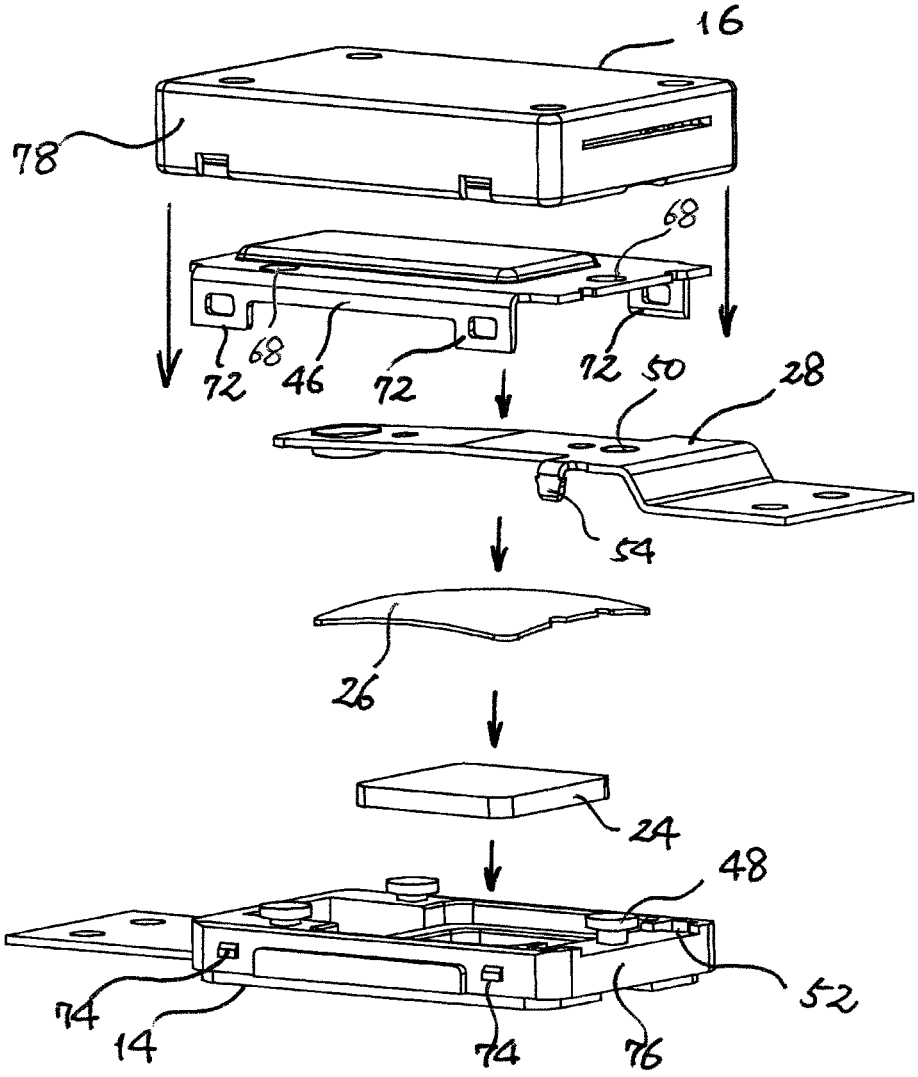
FIG. 3 schematically shows the protection device of the present invention in its exploded perspective view when the protection device that is complete as a device is broken down into its structural elements.

FIG. 3 shows schematically a state where the protection device of the present invention is broken down into its structural elements. It should be noted that FIG. 3 shows schematically the protection device 10 of the present invention in its exploded perspective view when the protection device that is complete as a device is broken down into its structural elements, and the protection device of the present invention may not necessarily be obtained by the assembling of these elements shown in FIG. 3.

The PTC component 24 is disposed on the terminal 12 which is disposed on the resin base 14, the bimetal component 26 is disposed on the protrusion 30 and the step section 30' such that it is positioned above the PTC component, and the arm 28 is disposed such that it is positioned above the bimetal component. It is noted that a contact state must not be established between the PTC component and the bimetal component and between the bimetal component and the arm; therefore, one or both may be separated. In the embodiment illustrated in FIG. 1, the PTC component 24 and the bimetal component 26 are in contact, but the bimetal component 26 and the arm 28 are separated.

The arm 28 has a hole 50 which, for example fits in a protrusion 48 provided on the resin base 14, and a leg 54 which fits into a hole 52 provided on the resin base. The arm 28 is positioned at a prescribed position relative to the resin base 14 by the fit of the protrusion 48 and the leg 52.

As can be understood from the perspective view of the resin base shown in FIG. 4, it is noted that the protrusion 48 is, for example, cylindrical and it may be formed such that the top thereof becomes larger than its lower part as illustrated by swaging after being fitted in the hole 50 (and after being fitted into a hole in the upper plate as described below). The space 20 within the resin base 14 shown in FIG. 4 has a part 56 which houses the PTC component 24 and a part 58 which houses the tip part 42 of the arm. A step portion which comprises the protrusion 30 and the step section 30' is circumferentially formed around the part 56, and a portion 60 of the terminal is exposed at the bottom of the part 56. A portion 62 of the terminal is exposed at the bottom of the part 58, and the portion 62 has a protrusion 64 to facilitate a contact with the contact 44 on the tip part 42 of the arm.

Figure 4:
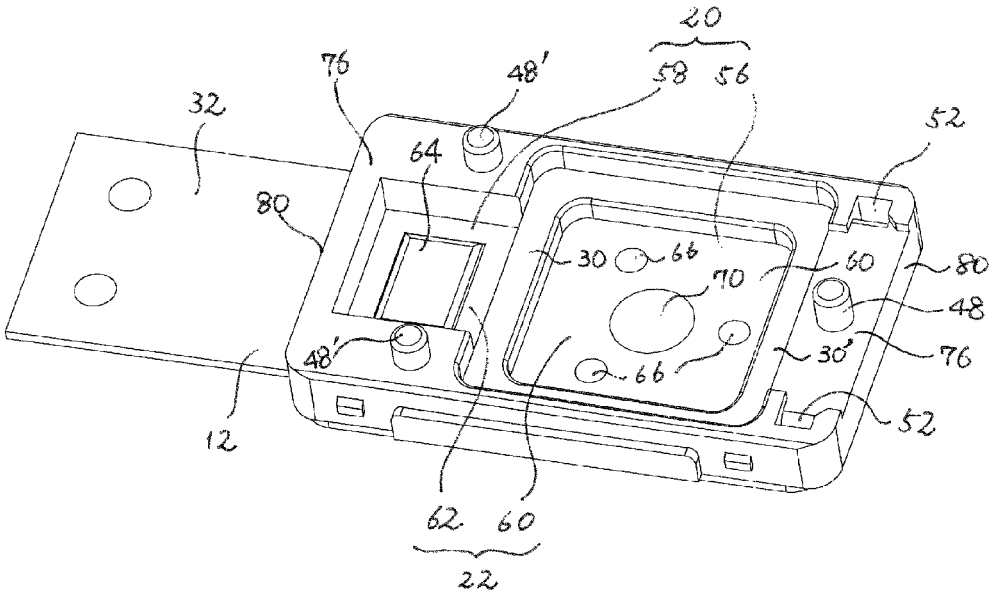
FIG. 4 schematically shows a resin base in its perspective view.

In the embodiment shown in FIG. 4, three low dome-shaped contacts 66 are disposed on the portion 60 of the terminal to ensure an electrical connection with the PTC component more easily. It is noted that the circular section which is positioned between these contacts shows an aperture which is provided on said portion and a resin 70 used in molding is present therein.

The PTC component 24 is placed within the part 56 of the resin base 14 such that it is electrically connected to a portion 60 of the terminal; the bimetal component 26 is placed on the circumferentially formed step portion which comprises the protrusion 30 and the step section 30'; and then the arm 28 is placed and the protrusion 48 is fitted into the hole 50. Next the upper plate 46 is positioned on the arm 28.

As shown in FIG. 3, the upper plate 46 has a pair of legs 72 on both sides, and the legs have an opening. This opening is configured so as to fit a protrusion 74 which is provided on both sides of the resin base 14. The positioning of the upper plate 46 may be performed by fitting the protrusions 48 and 48' of the resin base into the holes 68 and 68' provided thereon, fitting the protrusion 74 into the opening provided on each of the legs 72, and then swaging it by crushing the tops of the protrusions 48 and 48'.

The space 20 in the resin base is defined by this positioning of the upper plate, i.e. the upper surface of the surrounding wall and the lower surface of the upper plate are substantially in contact. It is particularly preferable that in this contact, the upper plate and the resin base are mutually energized with a slight force by the fitting of the above-described holes 68 and 68' and the leg 72. As a result, the periphery of the back surface of the metal upper plate is preferably slightly pressed in the upper surface of the resin plate wall by the elasticity of a resin constituting the resin plate, thereby easily ensuring "the space in the resin base is substantially closed" which is a characteristic of the present invention.

Figure 5:
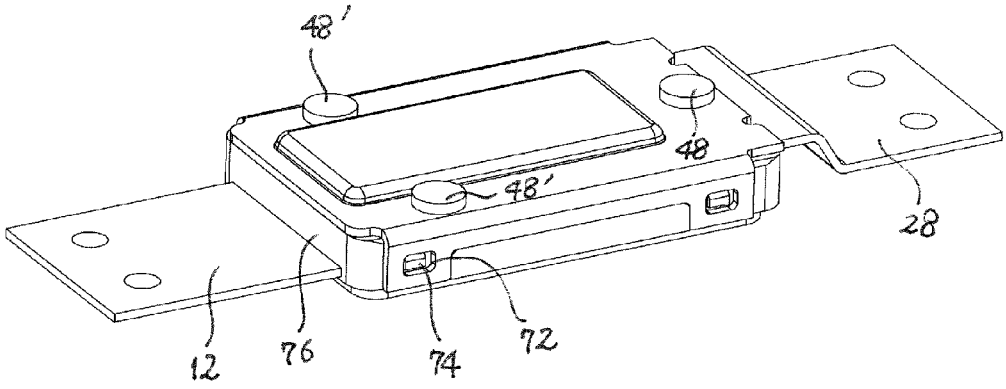
FIG. 5 schematically shows a state where the prescribed elements are placed in the space, and then the upper plate is positioned on the resin base in its perspective view.

FIG. 5 schematically shows a state after the upper plate 46 is positioned in its perspective view. This state corresponds to the state where the PTC component 24, the bimetal component 26 and the arm 28 are disposed over the terminal 12 exposed at the bottom of the space 20 of the resin base within the space 20 in the resin base, and the upper plate 46 which is disposed over the arm 28 substantially closes the space, and the assembly of these elements is formed.

As is illustrated, the upper plate 46 is preferably in a shape which the middle section protrudes outward (upward in the drawing) (i.e., a shape having a concavity when seeing it from below). This increases the strength of the upper plate so that the upper plate can retain its shape against a force working downward in FIG. 6 when insert molding, as described below.

The assembly shown in FIG. 5 is put in a prescribed metal mold and a resin is injection-molded, i.e. insert-molded in a state where the portion 38 of the arm extends outwards from one side of the metal mold and the portion 32 of the terminal extends outwards from the other side of the metal mold to form the resin cover 16 around the assembly, i.e. around the resin base 14. The melted resin supplied to the metal mold by this insert-molding becomes integral with the resin part of the resin base 14 at a place where melted resin comes in contact with the resin base to ensure the bonding between the resin base and the resin cover. In particular, when the resin constituting the resin base and the resin supplied by the insert molding are the same resin or are the compatible resins as described above, the integrity is even more ensured. The pressure of the resin supplied to the metal mold in the insert-molding presses the upper plate 46 toward the resin base 14 (i.e., downward in FIG. 1), the closing of the space in the resin base 14 with the upper plate 46 becomes even more ensured.

In a preferred embodiment, the resin cover 16 has a wall 78 adjacent to the wall 76 which defines the space 20 in the resin base. In more detail, the outside 80 of the wall 76 and the inside 82 of the wall 78 are adjacent, and these are integrally bonded. In the illustrated embodiment, the resin cover 16 is formed so as to have the side wall 78 adjacent to substantially the entire perimeter of the side wall 76 which defines the space in the resin base 14. In this case, the surfaces are mutually adjacent and bonded so that the above-described surface-bonding is formed, thereby lengthening the path of oxygen penetrating into the space 20 and more surely suppressing the penetration of oxygen into the space.

The process for producing the protection device of the present invention described above is a process for producing a protection device which comprises a resin base, a PTC component, a bimetal component, an arm and an upper plate which are housed in a resin housing wherein the process is characterized by comprising the steps of:

(1) forming a resin base which is integrated with a terminal and has a space over the terminal by insert molding using the terminal as an insert, (2) superposing the PTC component, the bimetal component, the arm and the upper plate over the terminal in this order to form an assembly thereof, and (3) placing the assembly as an insert into a metal mold, and insert-molding a resin cover in a state where the upper plate closes the space in the resin base, and a resin cover integrally bonded with the resin base by insert-molding is formed, and the integrally bonded parts constitutes a resin housing.

It is noted that in the process of the present invention, insert-molding is performed in step (1) and step (3). Such process is also called double-molding in which a primary molding and a secondary molding are performed, or an over-mold molding. In other words, the present invention is a process for producing the protection device as described above which comprises a step of forming an assembly between the primary insert-molding and the secondary insert-molding.

The element reference numerals are:

10—PTC device;
12—terminal;
14—resin base;
16—resin cover;
18—resin housing;
20—space;
22—part of terminal;
24—PTC component;
26—bimetal component;
28—arm;
30—protrusion;
30'—step section;
32—portion of terminal;
34—contact;
36, 38—portion of arm;
40—contact;
42—tip part of arm;
44—contact;
46—upper plate;
48—protrusion;
50—hole;
52—hole;
54—leg;
56—part containing PTC component;
58—part containing arm tip part;
60, 62—portion of terminal;
64—protrusion;
66—contact;
68, 68'—hole;
70—resin exposed part;
72—leg;
74—protrusion;
76, 78—wall;
80—outer side of wall.

What is claimed is:

1. A protection device which comprises a resin base, a PTC component, a bimetal component, an arm and an upper plate which are housed in a resin housing, wherein:

the resin base comprises a terminal which is integrated with the resin base by insert molding and a resin base wall extending upward from the resin base, the protection device further comprises a resin cover which is formed by insert molding so as to cover the PTC component, the bimetal component, the arm and the upper plate which are superposed in this order over the terminal within a space in the resin base, the resin cover having a resin cover wall extending downward from the resin cover, the space in the resin base is substantially closed by the upper plate, an outer surface of the resin base wall is integrally bonded with substantially an entire perimeter of an inner surface of the resin cover wall to define the resin housing, wherein the upper plate includes legs extending downward from opposing sides thereof and over the resin base wall in a parallel relationship therewith, each of the legs having an opening formed therein, wherein protrusions extend perpendicularly from the resin base wall through the openings, the terminal and the arm are electrically connected in series in a normal state, and in an abnormal state where the bimetal component is activated, the terminal and the arm are electrically cut off, while the terminal, the PTC component, the bimetal component, and the arm are electrically connected in series in this order.

2. The protection device according to claim 1, wherein the outer surface and the inner surface are integrally bonded in an adjacent state.

3. The protection device according to claim 1, wherein the resin base and the resin cover are formed of a same plastic material or a mutually compatible plastic material.

4. A process for producing a protection device which comprises a resin base, a PTC component, a bimetal component, an arm and an upper plate which are housed in a resin housing, the process comprising:

forming the resin base which is integrated with a terminal and has a space over the terminal by insert molding using the terminal as an insert, forming a resin base wall extending upward from the resin base, superposing the PTC component, the bimetal component, the arm and the upper plate over the terminal in this order to form an assembly thereof, wherein the upper plate includes legs extending downward from opposing sides thereof and over the resin base wall in a parallel relationship therewith, each of the legs having an opening formed therein, wherein protrusions extend perpendicularly from the resin base wall through the openings, and placing the assembly as an insert into a metal mold, and insert-molding a resin cover having a resin cover wall extending downward from the resin cover in a state where the upper plate closes the space in the resin base, integrally bonding an outer surface of the resin base wall with substantially an entire perimeter of an inner surface of the resin cover wall to define the resin housing.

5. The process for producing the protection device according to claim 4, wherein the protection device is a device wherein:

the resin cover covers the PTC component, the bimetal component, the arm and the upper plate which are superposed in this order over the terminal within the space in the resin base;

the terminal and the arm are electrically connected in series in a normal state; and in an abnormal state where the bimetal component is activated, the terminal and the arm are electrically cut off, while the terminal, the PTC component, the bimetal component, and the arm are electrically connected in series in this order.

6. The protection device according to claim 2, wherein the resin base and the resin cover are formed of a same plastic material or a mutually compatible plastic material.

7. The process for producing the protection device according to claim 5, wherein the outer surface and the inner surface are integrally bonded in an adjacent state.

8. The process for producing the protection device according to claim 5, wherein the resin base and the resin cover are formed of a same plastic material or a mutually compatible plastic material.

9. The protection device according to claim 1, wherein at least a portion of the upper plate extends between the resin base wall and the resin cover wall.

* * * * *